US010288354B2

(12) United States Patent
Choi et al.

(10) Patent No.: US 10,288,354 B2
(45) Date of Patent: May 14, 2019

(54) HIGH-EFFICIENCY PLATE TYPE HEAT EXCHANGER

(71) Applicant: KITURAMI BOILER CO., LTD., Gyeongsangbuk-do (KR)

(72) Inventors: Sung-Hwan Choi, Seoul (KR); Youn-cheol Shin, Seoul (KR); Tae-young Kim, Gyeongsangbuk-do (KR); Hae-young Jung, Daegu (KR)

(73) Assignee: KITURAMI BOILER CO., LTD., Gyeongsangbuk-do (KR)

( * ) Notice: Subject to any disclaimer, the term of this patent is extended or adjusted under 35 U.S.C. 154(b) by 0 days.

(21) Appl. No.: 15/316,351

(22) PCT Filed: Nov. 28, 2014

(86) PCT No.: PCT/KR2014/011591
§ 371 (c)(1),
(2) Date: Dec. 6, 2016

(87) PCT Pub. No.: WO2016/047859
PCT Pub. Date: Mar. 31, 2016

(65) Prior Publication Data

US 2017/0184350 A1 Jun. 29, 2017

(30) Foreign Application Priority Data

Sep. 24, 2014 (KR) ..... 10-2014-0127879

(51) Int. Cl.
*F28F 3/02* (2006.01)
*F28D 9/00* (2006.01)
*F28F 3/04* (2006.01)

(52) U.S. Cl.
CPC ..... *F28D 9/0037* (2013.01); *F28F 3/02* (2013.01); *F28F 3/042* (2013.01); *F28D 9/0043* (2013.01)

(58) Field of Classification Search
CPC .... F28D 9/0006; F28D 9/0031; F28D 9/0043; F28D 3/083; F28D 2021/0054;
(Continued)

(56) References Cited

U.S. PATENT DOCUMENTS

2004/0206487 A1* 10/2004 Blomgren ..... F28D 9/005 165/167
2006/0225283 A1* 10/2006 Rissler ..... B23K 1/0012 29/890.041

(Continued)

FOREIGN PATENT DOCUMENTS

KR 20060104174 10/2006
KR 1020080006795 1/2008

(Continued)

*Primary Examiner* — Davis D Hwu
(74) *Attorney, Agent, or Firm* — IPLA P.A.; James E. Bame

(57) ABSTRACT

A high-efficiency plate type heat exchanger increases a heat-exchanging efficiency with an exhaust gas by connecting unit fluidized beds formed with stacked heat exchanging plates to each other in up and down directions, and elongating a flow path of circulating water to be greater than or equal to two passes (2-PASS). The heat exchanger retrieves heat of an exhaust gas by increasing a flow amount of circulating water of a portion close to a burner while a circulation path is elongated as described above. In addition, the high-efficiency plate type heat exchanger increases efficiency thereof by inserting a baffle plate having distribution holes between unit fluidized beds, controlling a flow of an exhaust gas while reducing an exhaust speed of the exhaust gas using heat exchanging fins of the baffle plate, absorbing heat of the exhaust gas, and effectively using a heat transfer area.

5 Claims, 6 Drawing Sheets

(58) Field of Classification Search
CPC ..... F28D 9/0037; F28F 3/083; F28F 2280/02; F28F 3/02; Y10T 29/49352
USPC ..... 165/167
See application file for complete search history.

(56) References Cited

U.S. PATENT DOCUMENTS

2007/0251671 A1* 11/2007 Barnes ..... F28D 1/0333 165/83
2010/0276128 A1* 11/2010 Taylor ..... F28D 9/0006 165/157
2013/0020062 A1* 1/2013 Blomgren ..... F28D 9/005 165/166

FOREIGN PATENT DOCUMENTS

KR 100846294 7/2008
KR 101389465 4/2014

* cited by examiner

[Fig. 1]
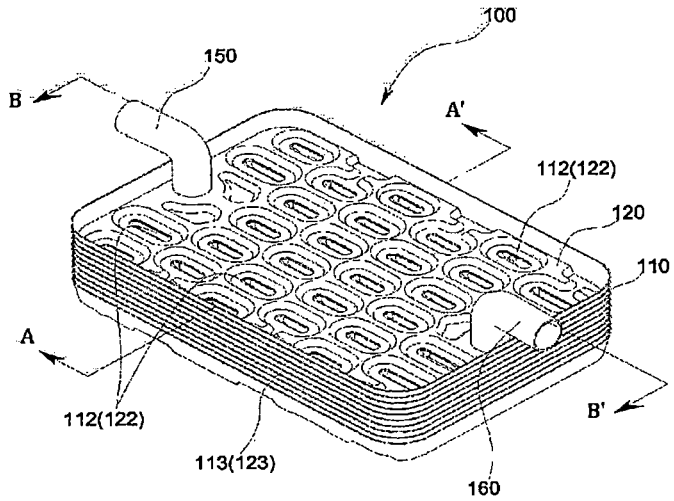
[Fig. 2]
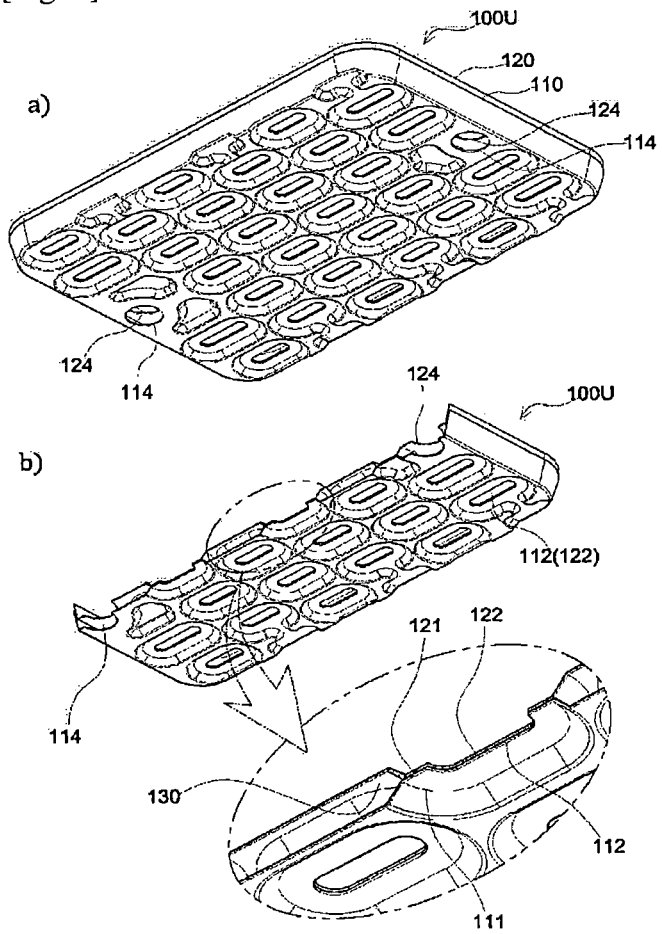

[Fig. 3]
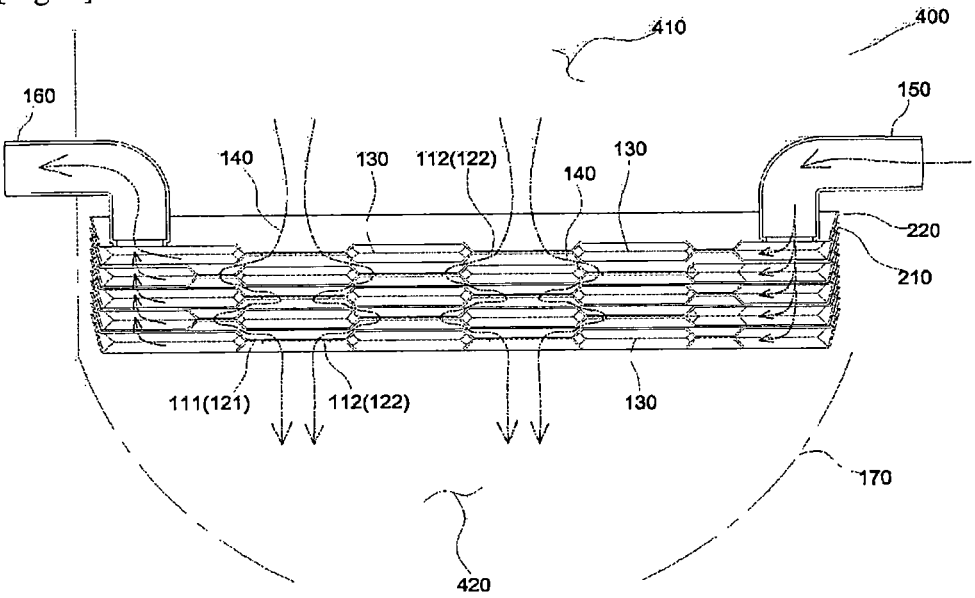
[Fig. 4]
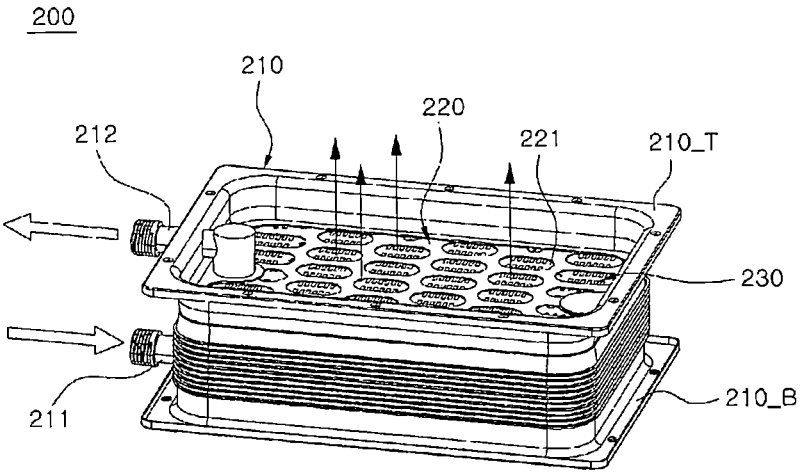
[Fig. 5]
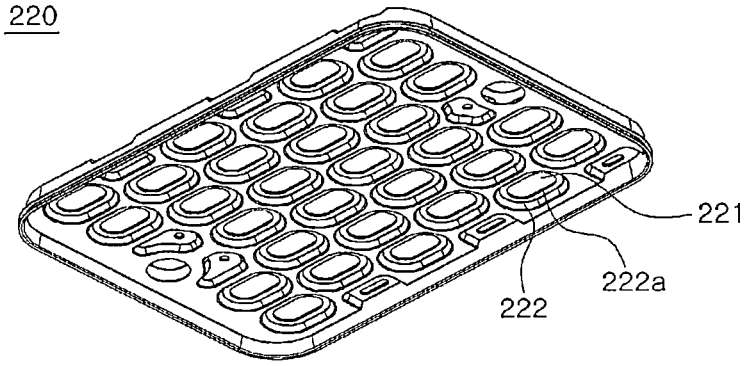

[Fig. 6]
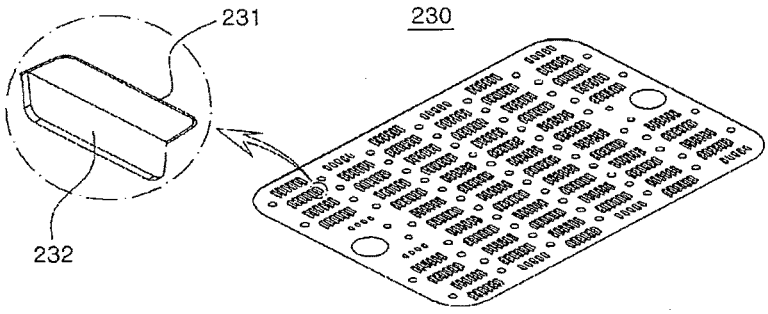
[Fig. 7]
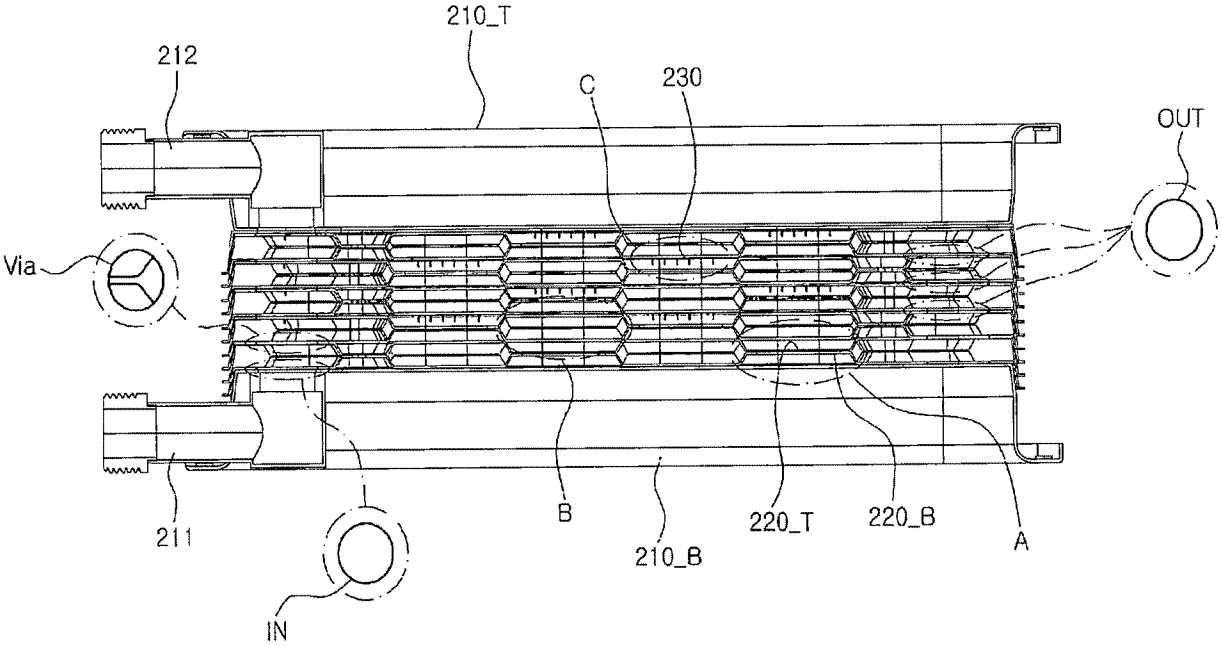

[Fig. 8a]
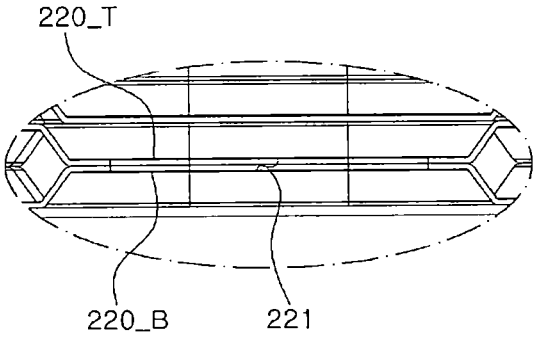
[Fig. 8b]
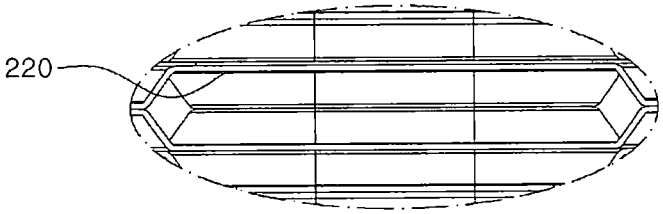
[Fig. 8c]
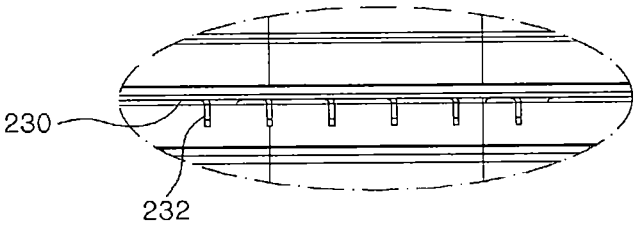

[Fig. 9]
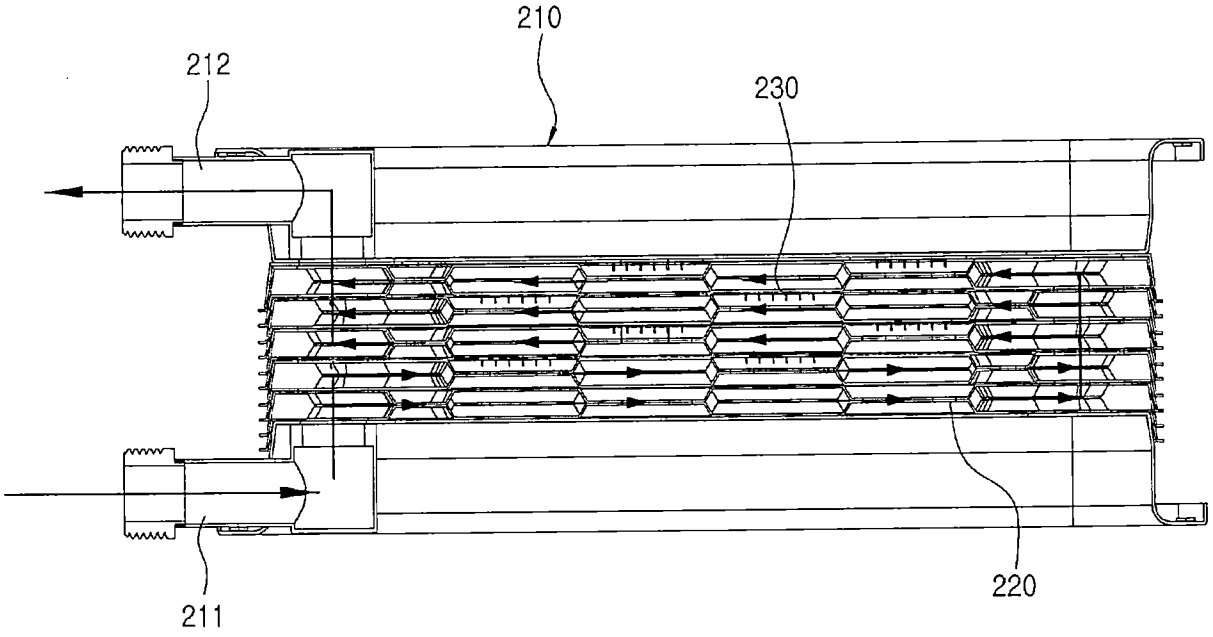

[Fig. 10]
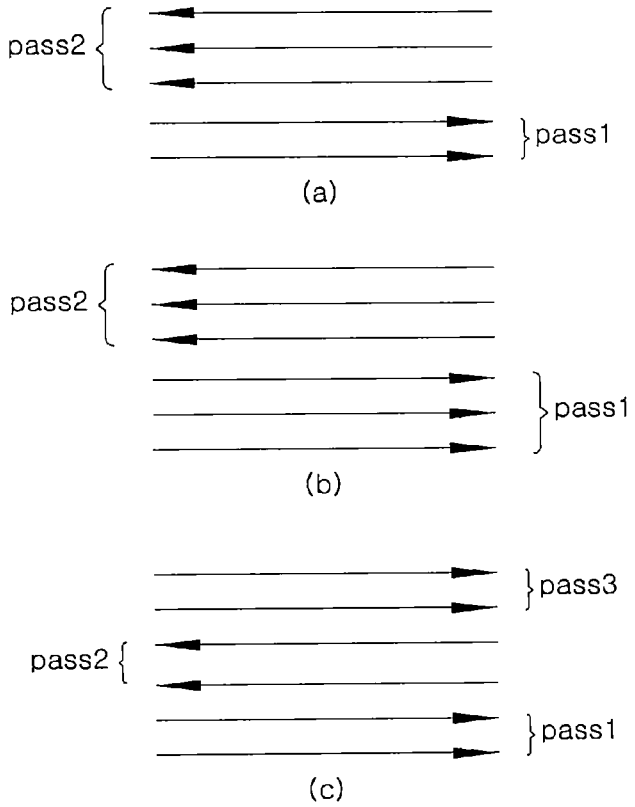

HIGH-EFFICIENCY PLATE TYPE HEAT EXCHANGER

BACKGROUND

The present invention relates to a high-efficiency plate type heat exchanger capable of increasing a heat-exchanging efficiency with an exhaust gas by connecting unit fluidized beds formed with stacked heat exchanging plates to each other in up and down directions, and elongating a flow path of circulating water to be greater than or equal to two passes (2-PASS).

In addition, the present invention relates to a high-efficiency plate type heat exchanger capable of efficiently retrieving heat of an exhaust gas by increasing a flow amount of circulating water of a portion close to a burner while a circulation path is elongated as described above.

In addition, the present invention relates to a high-efficiency plate type heat exchanger capable of increasing efficiency thereof by inserting a baffle plate having distribution holes between unit fluidized beds, absorbing heat of an exhaust gas, and effectively using a heat transfer area.

Background Art

A heat exchanger is an apparatus which transfers heat by intersecting a heating fluid and a fluid to be heated which have different temperatures, and is widely used for heating, air-conditioning, power generating, cooling, waste heat retrieving, and the like in a boiler and other various cooling and heating apparatuses including an air conditioner.

A condensing boiler is a typical product to which a heat exchanger is applied. A condensing boiler includes a sensible heat exchanger which performs a first heat exchange with combustion heat of a burner and a latent heat exchanger which performs a second heat exchange with an exhaust gas of the combustion heat.

Meanwhile, plate type heat exchangers have recently been applied as heat exchangers for various technical fields including a condensing boiler. Since a plate type heat exchanger is assembled by stacking a plurality of heat exchanging plates, there are merits in that manufacturing thereof is easy and heat-exchanging efficiency is high while a size thereof decreases.

For example, in a plate type latent heat exchanger in Korea Laid-Open Patent Publication No. 10-1389465 (see FIG. 1), upwardly bent plates 110 and downwardly bent plates 120 are alternately stacked, and a water inlet pipe 150 and a water outlet pipe 160 are installed at both side portions thereof.

In addition, as illustrated in FIG. 2, a plurality of exhaust gas communication holes 112 and 122 are formed at each of the upwardly bent plate 110 and the downwardly bent plate 120, and the communication holes 112 and 122 are coupled to each other by bent perimeters of the communication holes 112 and 122.

Accordingly, as illustrated in FIG. 3, an exhaust gas passes through the exhaust gas communication holes 112 and 122 and is discharged, and circulating water exchanges heat with the exhaust gas while flowing along a path between the upwardly bent plate 110 and the downwardly bent plate 120 (that is, a circulating water path).

However, in the above-described conventional technology, circulating water supplied from the water inlet pipe 150 is commonly supplied to a circulating water path of each layer in one direction, the supplied circulating water linearly moves in each of the layers in the other direction (that is, one pass (1-PASS)), and is then collected in the water outlet pipe 160.

Accordingly, since the circulating water paths of the layers are not connected to each other in up and down directions and independent paths are provided, flow paths of the circulating water are short, and thus there is a problem in that heat is not sufficiently exchanged with an exhaust gas.

In addition, a large amount of circulating water ejected at high pressure from the water inlet pipe 150 by a pump is firstly supplied to a lowest layer (based on the drawings) farthest from a burner, and a relatively small amount of the circulating water is supplied to a highest layer close to the burner.

Accordingly, since heat exchange with an exhaust gas using a sufficient amount of water cannot be performed at the highest layer at which a temperature of the exhaust gas is highest because the burner is close thereto, there is a problem in that heat of the exhaust gas is not efficiently retrieved.

In addition, the plurality of exhaust gas communication holes 112 and 122 are conventionally disposed to be dispersed in the upwardly bent plate 110 and the downwardly bent plate 120, and an exhaust gas is exhausted therethrough.

Accordingly, since the exhaust gas is quickly exhausted through the big exhaust gas communication holes 112 and 122 without any particular resistance, there is a problem in that heat is exchanged with circulating water for an insufficient amount of time.

SUMMARY OF THE INVENTION

The present invention is directed to providing a high-efficiency plate type heat exchanger capable of efficiently retrieving heat of an exhaust gas by increasing a flow amount of circulating water of a portion close to a burner while elongating a flow path of the circulating water to be greater than or equal to two passes (2-PASS).

In addition, the present invention is directed to providing a high-efficiency plate type heat exchanger capable of increasing efficiency of a heat exchanger by absorbing heat of an exhaust gas using a baffle plate and effectively using heat transfer areas of circulating water and the exhaust gas.

Technical Solution

One aspect of the present invention provides a high-efficiency plate type heat exchanger including: a heat exchanger body including open upper and lower portions, a water inlet into which circulating water is introduced provided at one side thereof, and a water outlet through which the circulating water is discharged provided at the other side thereof, and configured to exhaust a high temperature exhaust gas generated by a burner; and a plurality of heat exchanging plates stacked in the heat exchanger body, forming a plurality of unit fluidized beds in which paths through which the circulating water flows are provided, and including a plurality of exhaust holes so that the exhaust gas passes perpendicularly through the unit fluidized beds, wherein the water inlet is connected to a lowest layer among the plurality of unit fluidized beds, the water outlet is connected to a highest layer among the plurality of unit fluidized beds, and a connection between the unit fluidized beds is made to be greater than or equal to two passes (2-PASS) including a first path along which the circulating water flows from one side to the other side and a second path along which the circulating water flows from the other side to the one side.

Here, it is preferable that some of the unit fluidized beds disposed in order from the closest to the burner among the unit fluidized beds having a multilayer structure have circulating water inlet portions commonly connected to the water inlet through a fluid guide.

In addition, it is preferable that an opening area of a circulating water supply path formed along the fluid guide be adjusted so that more circulating water supplied from the water inlet is supplied to a unit fluidized bed disposed closer to the burner than to a unit fluidized bed disposed farther from the burner.

In addition, it is preferable that the high-efficiency plate type heat exchanger further include a baffle plate inserted into one or more gaps between the unit fluidized beds and including a plurality of distribution holes with a smaller size than the exhaust holes at portions at which the baffle plate overlaps the exhaust holes of the heat exchanging plate.

In addition, it is preferable that a plurality of heat exchanging fins with a smaller size than the exhaust holes be formed on the baffle plate to protrude at each of the portions at which the baffle plate overlaps the exhaust holes of the heat exchanging plate, and the heat exchanging fins protrude in a direction facing the exhaust hole.

As described above, according to the present invention, a flow path of circulating water is made to be greater than or equal to two passes (2-PASS) by connecting unit fluidized beds formed at stacked heat exchanging plates to each other in up and down directions. Accordingly, the flow path of the circulating water is elongated, and thus heat-exchanging efficiency with an exhaust gas increases.

In addition, according to the present invention, a flow amount of circulating water of a portion close to a burner is relatively increased by adjusting an opening rate of a fluid guide which commonly connects unit fluidized beds. Accordingly, heat of an exhaust gas is efficiently retrieved.

In addition, according to the present invention, efficiency of the heat exchanger is improved by inserting a baffle plate having a distribution hole between unit fluidized beds, absorbing heat of an exhaust gas using a heat exchanging fin of the baffle plate, and effectively using a heat transfer area.

BRIEF DESCRIPTION OF DRAWINGS

FIG. 1 is a perspective view illustrating a latent heat exchanger using plates according to a conventional technology.

FIG. 2 is a perspective view illustrating a state in which the plates in FIG. 1 are coupled to each other.

FIG. 3 is a view illustrating flows of circulating water and an exhaust gas in the latent heat exchanger in FIG. 1.

FIG. 4 is a perspective view illustrating a high-efficiency plate type heat exchanger according to the present invention.

FIG. 5 is a perspective view illustrating a heat exchanging plate of the high-efficiency plate type heat exchanger according to the present invention.

FIG. 6 is a perspective view illustrating a baffle plate of the high-efficiency plate type heat exchanger according to the present invention.

FIG. 7 is a cross-sectional view illustrating the high-efficiency plate type heat exchanger according to the present invention.

FIGS. 8A to 8C are views respectively illustrating portions A, B, and C in FIG. 7.

FIG. 9 is a schematic view illustrating a two passes (2-PASS) circulating water flow path of the high-efficiency plate type heat exchanger according to the present invention.

FIG. 10 is a schematic view illustrating various flow paths of circulating water which may be applied to the high-efficiency plate type heat exchanger according to the present invention.

DETAILED DESCRIPTION OF THE INVENTION

Hereinafter, a high-efficiency plate type heat exchanger according to exemplary embodiments of the present invention will be described in detail with reference to the accompanying drawings.

However, although an example in which the present invention is applied to a sensible heat exchanger of a boiler will be described below, it should be apparent that the present invention may be applied to the other technical fields.

In addition, although a direction in which a burner is installed is defined as a lower direction and the opposite direction is defined as an upper direction below, it should be apparent that the up and down directions may be changed depending on an installation position of a burner.

As illustrated in FIG. 4, a high-efficiency plate type heat exchanger 200 according to the present invention includes a heat exchanger body 210, heat exchanging plates 220 stacked in the heat exchanger body 210 and configured to form a 'unit fluidized bed' having a multilayer structure, and baffle plates 230 inserted between unit fluidized beds.

Each of the unit fluidized bed is formed with two heat exchanging plates 220 including an upper heat exchanging plate 220_T and a lower heat exchanging plate 220_B which are vertically disposed in series, and a path formed in an inner space between the upper heat exchanging plate 220_T and the lower heat exchanging plate 220_B which are sealed corresponds to a unit fluidized bed through which circulating water flows.

For example, the heat exchanger according to the present invention is assembled by preparing the heat exchanger body 210 including an upper body 210_T and a lower body 210_B, stacking a plurality of heat exchanging plates 220 between the upper body 210_T and the lower body 210_B, and inserting one of the baffle plates 230 for every predetermined number of heat exchanging plates 220 therebetween.

The heat exchanger according to the present invention including the above-described structure is typically used as a sensible heat exchanger of an upward combustion type boiler in which a burner (not shown) configured to provide combustion heat (for instance, flame and an exhaust gas) is installed at a lower portion of the heat exchanger body 210.

In this case, circulating water (for instance, low temperature direct water) is supplied through a water inlet 211 provided at the lower portion of the heat exchanger body 210, and the introduced circulating water circulates through the unit fluidized beds greater than or equal to two passes (2-PASS) and is discharged through a water outlet 212.

One pass (1-PASS) denotes that circulating water flows from one side end to the other side end of a unit fluidized bed (see FIG. 10), and two passes (2-PASS) denotes that circulating water flows from one side to the other side and flows from the other side to the one side in a direction opposite thereto.

As described above, while the circulating water flows along a long path greater than or equal to two passes (2-PASS), a high temperature exhaust gas generated by a burner sequentially passes through the heat exchanging plate 220 positioned at a lowest layer to the heat exchanging plate 220 positioned at a highest layer, is exhausted upward, and passes through the baffle plate 230 while being exhausted.

Accordingly, while low temperature circulating water circulates along the unit fluidized beds, the high temperature exhaust gas ascends across a plurality of unit fluidized beds, and heat is exchanged by thermal contact between the circulating water and the exhaust gas through this process. The circulating water heated by the heat exchange is supplied as hot water or heating water.

To this end, upper and lower portions of the heat exchanger body 210 are open and exhaust the high temperature exhaust gas generated by the burner. When the burner is disposed at the lower portion of the heat exchanger body 210 (as in the drawings), exhaust gas introduced from the lower portion passes through an inside of the heat exchanger body 210 and is exhausted upward.

In addition, The water inlet 211 through which circulating water is introduced is included at one side of the heat exchanger body 210, and the water outlet 212 through which the circulating water is discharged is included at the other side. The water inlet 211 and the water outlet 212 are connected with a plurality of unit fluidized beds interposed therebetween.

That is, the water inlet 211 is connected to a lowest layer among the plurality of unit fluidized beds and supplies circulating water toward the unit fluidized beds, and the water outlet 212 is connected to a highest layer among the plurality of unit fluidized beds and discharges the circulating water which has exchanged heat while passing through the unit fluidized beds.

When the heat exchanger body 210 includes the upper body 210_T and the lower body 210_B, the water inlet 211 is fixedly installed at the lower body 210_B, and the water outlet 212 is fixedly installed at the upper body 210_T. A water pipe is connected to an outer end of each of the water inlet 211 and the water outlet 212.

The heat exchanging plate 220 is formed to have a multilayer structure having the unit fluidized beds, wherein the plurality of unit fluidized beds are stacked in the heat exchanger body 210 and circulating water flows therethrough. A plurality of exhaust holes 221 are formed in the heat exchanging plate 220 so that an exhaust gas passes perpendicularly through the heat exchanging plates 220.

As illustrated in FIG. 5, the heat exchanging plate 220 is formed in a shape of a roughly rectangular plate, and for instance, includes a installing hook hole extending a predetermined length downward along a perimeter of the rectangular plate.

In addition, the plurality of exhaust holes 221 of the heat exchanging plate 220 have a shape of an elongated hole (or an elliptical shape), and are disposed to be dispersed. Bent portions 222 having a predetermined height are formed at a perimeter of the exhaust holes 221. Bonding portions 222*a* are included at tempered portions of the bent portions 222.

Here, when the bent portions 222 of the upper heat exchanging plate 220_T and the lower heat exchanging plate 220_B, which are vertically disposed in series, are stacked to face each other, the bonding portions 222*a* of the upper heat exchanging plate 220_T and the lower heat exchanging plate 220_B are pressed against each other, and thus water leakage is prevented.

Accordingly, the unit fluidized bed is formed in the inside space between the two upper heat exchanging plate 220_T and lower heat exchanging plate 220_B, and an exhaust gas passes through the exhaust hole 221 regardless thereof.

This is similar to the conventional technology shown in FIG. 2, and since surroundings of the exhaust holes 221 are blocked by the bonding portions 222*a* as was already described with reference to FIG. 2, the circulating water and the exhaust gas do not come into not contact with each other and are not mixed, and each flows along an independent path.

The baffle plate 230 is inserted into one or more 'gaps between the unit fluidized beds', and as illustrated in FIG. 6, a plurality of distribution holes 231 smaller than the exhaust holes 221 are formed at each portion at which the baffle plate 230 overlaps the exhaust holes 221 of the heat exchanging plate 220.

For example, the baffle plate 230 is cut into a 'U' pattern and is used as the distribution hole 231. The distribution hole 231 disperses an exhaust gas which passed through the exhaust hole 221 again, reduces an exhaust speed of the exhaust gas, and thus prevents heat-exchanging efficiency from being lowered due to an excessively high gas exhausting speed.

Furthermore, a plurality of heat exchanging fins 232 with a smaller size than the exhaust holes 221 are formed to protrude at each of the portions at which the baffle plate 230 overlaps the exhaust holes 221 of the heat exchanging plate 220. Each of the heat exchanging fins 232 protrudes in a direction facing the exhaust hole 221.

One example of the heat exchanging fin 232 having a shape of small plate, which protrudes downward from a bottom surface of the baffle plate 230, is illustrated in FIG. 6. Such a heat exchanging fin 232 serves to improve efficiency of the heat exchanger by effectively using an area through which heat is transferred to an exhaust gas.

Meanwhile, one example of a heat exchanger formed by stacking ten heat exchanging plates 220 is illustrated in FIG. 7. When there are ten heat exchanging plates 220, since two upper and lower heat exchanging plates 220_T and 220_B form one unit fluidized bed, five unit fluidized beds are formed and stacked.

That is, one unit fluidized bed is formed between first and second heat exchanging plates 220, and one unit fluidized bed is formed between third and fourth heat exchanging plates 220.

Three more unit fluidized beds are formed thereon in the same manner.

In addition, the water inlet 211 is connected to a first unit fluidized bed which is the lowest layer among the unit fluidized beds having the multilayer structure, and the water outlet 212 is connected to a fifth unit fluidized bed among the plurality of unit fluidized beds.

Particularly, a connection between the unit fluidized beds is made to be greater than or equal to two passes (2-PASS) including a first path in which circulating water flows from one side to the other side and a second path in which the circulating water flows from the other side to the one side. FIG. 7 is a view corresponding to two passes (2-PASS).

Accordingly, in the heat exchanger according to the present invention, since all flow paths of circulating water are connected to be greater than or equal to two passes (2-PASS) instead of independent one pass (1-PASS) with which a flow path of circulating water is formed one pass (1-PASS) in a conventional case, a flow length is elongated and heat is exchanged for a sufficient time.

Portion A in FIG. 7, which denotes a portion of the exhaust hole 221, is enlarged and illustrated in FIG. 8A, portion B in FIG. 7, which denotes a part of a unit fluidized bed, is enlarged and illustrated in FIG. 8B, and portion C in FIG. 7, which denotes a stacked portion of the baffle plate 230, is enlarged and illustrated in FIG. 8C.

Furthermore, in the heat exchanger according to the present invention, some of the unit fluidized beds are connected through a fluid guide Via in order from the closest to the burner among the unit fluidized beds having the multi-layer structure. Accordingly, all circulating water inlet portions are commonly connected to the water inlet 211.

Two unit fluidized beds disposed at lowest layers are connected through the fluid guide Via in FIG. 7 as one embodiment. That is, all of the circulating water inlet portions of the unit fluidized beds disposed at a first layer and a second layer are provided at one end close to the water inlet 211, and the first layer and the second layer are connected through the fluid guide Via.

Specifically, the circulating water inlet portions provided at the upper heat exchanging plate 220_T of the unit fluidized bed formed at the first layer and the lower heat exchanging plate 220_B of the unit fluidized bed formed at the second layer are processed to form the fluid guide Via.

Accordingly, when circulating water is simultaneously supplied to the first layer and the second layer through the fluid guide Via, a large amount of heat is efficiently retrieved from a relatively high temperature exhaust gas due to close proximity to the burner by using a large amount of circulating water (which flows along the unit fluidized beds of the two layers).

Since the unit fluidized beds of the first layer and the second layer are commonly connected through the fluid guide Via as described above, circulating water simultaneously flows in one direction in the unit fluidized beds of the first layer and the second layer, and is supplied to unit fluidized beds of third to fifth layers stacked thereon.

However, it is preferable that a relatively large amount of circulating water be introduced through a unit fluidized bed formed at a side close to the burner even between the unit fluidized beds commonly connected through the fluid guide Via.

Accordingly, an opening of the fluid guide Via is adjusted so that more circulating water is supplied to the unit fluidized bed disposed closer to the burner than to a unit fluidized bed disposed farther from the burner.

For example, when two unit fluidized beds are connected through the fluid guide Via, as two small openings are formed at a part of the fluid guide Via so that a ratio of supplied circulating water of a first layer to a second layer is approximately 6:4, a part of the supplied circulating water is deflected and sent to the first layer.

A cross section of another inlet hole IN or outlet hole OUT formed in the heat exchanging plate 220 is also illustrated in a small circle in FIG. 7, and in the small circle it can be seen that an entire area of the fluid guide Via is smaller than that of the inlet hole IN or the outlet hole OUT.

In addition, the heat exchanger according to the present invention includes the baffle plate 230 as describe above, and the baffle plate 230 disperses and exhausts an exhaust gas and simultaneously reduces an exhaust speed thereof. In addition, the baffle plate 230 serves to effectively use a heat transfer area.

However, as illustrated above, the baffle plate 230 also serves to control a flow of an exhaust gas, and the baffle plate 230 is positioned on the unit fluidized bed of the second layer in FIG. 7 as one embodiment. In addition, the baffle plate 230 is positioned on each of the third to fifth unit fluidized beds.

As described above, in the heat exchanger according to the present invention, the insertion number or insertion positions of the baffle plates 230 is freely adjusted according to the number of stacked heat exchanging plates 220 and the corresponding number of unit fluidized beds, the number of unit fluidized beds commonly connected through the fluid guide Via, or the like, and thus a state thereof is optimized.

FIG. 9, which was not described above, is a view illustrating a two passes (2-PASS) circulating water flow generated according to ten heat exchanging plates 220, which have the same shape as shown in FIG. 7, being stacked on each other, FIG. 10A is a schematic view illustrating flows of circulating water shown in FIG. 9 and FIG. 7.

In addition, FIG. 10B is a view illustrating a two passes (2-PASS) circulating water flow generated by stacking 12 heat exchanging plates 220, and the number of unit fluidized beds is increased by increasing the number of heat exchanging plates 220 to increase a capacity of the heat exchanger.

However, even when 12 heat exchanging plates 220 are stacked as illustrated in FIG. 10C, three passes (3-PASS) circulating water flow may be generated, and in this case, the water inlet 211 and the water outlet 212 are disposed opposite each other.

INDUSTRIAL APPLICABILITY

While specific embodiments of the present invention have been described above in detail, the spirit and scope of the embodiments of the present invention are not limited thereto and may be variously modified and changed by those skilled in the art in a range in which a gist of the present invention is not changed.

Thus, because the above-described embodiments are provided to completely inform those skilled in the art of the scope of the invention, it should be understood by those skilled in that art that the embodiments are illustrative in all aspects and non-limiting, and the present invention is only defined by the claims.

The invention claimed is:

1. A high-efficiency plate type heat exchanger comprising:

a heat exchanger body (210) including open upper and lower portions, a water inlet (211) into which circulating water is introduced provided at one side thereof, and a water outlet (212) through which the circulating water is discharged provided at the other side thereof, and configured to exhaust a high temperature exhaust gas generated by a burner; and a plurality of heat exchanging plates (220) stacked in the heat exchanger body (210), forming a plurality of unit fluidized beds in which paths through which the circulating water flows are provided, and including a plurality of exhaust holes (221) formed therein so that the exhaust gas passes perpendicularly through the unit fluidized beds, wherein the water inlet (211) is connected to a lowest layer among the plurality of unit fluidized beds, the water outlet (212) is connected to a highest layer among the plurality of unit fluidized beds, and a connection between the unit fluidized beds is made to be greater than or equal to two passes (2-PASS) including a first path along which the circulating water flows from one side to the other side and a second path along which the circulating water flows from the other side to the one side.

2. The high-efficiency plate type heat exchanger of claim 1, wherein some of the unit fluidized beds disposed in order from the closest to the burner among the unit fluidized beds having a multilayer structure have circulating water inlet portions commonly connected to the water inlet (211) through a fluid guide (Via).

3. The high-efficiency plate type heat exchanger of claim 2, wherein an opening area of a circulating water supply path formed along the fluid guide (Via) is adjusted so that more circulating water supplied from the water inlet (211) is supplied to a unit fluidized bed disposed closer to the burner than to a unit fluidized bed disposed farther from the burner.

4. The high-efficiency plate type heat exchanger of claim 1, further comprising a baffle plate (230) inserted into one or more gaps between the unit fluidized beds and including a plurality of distribution holes (231) with a smaller size than the exhaust holes (221) at portions at which the baffle plate (230) overlaps the exhaust holes (221) of the heat exchanging plate (220).

5. The high-efficiency plate type heat exchanger of claim 4, wherein a plurality of heat exchanging fins (232) with a smaller a size than the exhaust holes (221) are formed on the baffle plate (230) to protrude at each of the portions at which the baffle plate (230) overlaps the exhaust holes (221) of the heat exchanging plate (220), and the heat exchanging fins (232) protrude in a direction facing the exhaust hole (221).

* * * * *